US009964267B1

(12) United States Patent
Van Ee

(10) Patent No.: US 9,964,267 B1
(45) Date of Patent: May 8, 2018

(54) APPARATUS, METHOD, AND SYSTEM FOR TILTED POLE TOP FITTER

(71) Applicant: Musco Corporation, Oskaloosa, IA (US)

(72) Inventor: Nathanael J. Van Ee, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 36 days.

(21) Appl. No.: 15/147,655

(22) Filed: May 5, 2016

Related U.S. Application Data

(60) Provisional application No. 62/160,317, filed on May 12, 2015.

(51) Int. Cl.

| | |
|---|---|
| ***F21V 3/02*** | (2006.01) |
| ***F21S 8/08*** | (2006.01) |
| ***F21V 17/12*** | (2006.01) |
| ***F21V 21/28*** | (2006.01) |
| ***F21V 23/00*** | (2015.01) |
| ***F21V 11/00*** | (2015.01) |
| ***F21V 21/116*** | (2006.01) |
| *F21W 131/105* | (2006.01) |

(52) U.S. Cl.
CPC ..... *F21S 8/086* (2013.01); *F21V 11/00* (2013.01); *F21V 17/12* (2013.01); *F21V 21/116* (2013.01); *F21V 21/28* (2013.01); *F21V 23/003* (2013.01); *F21W 2131/105* (2013.01)

(58) Field of Classification Search
CPC ..... F21S 8/086; F21V 11/00; F21V 21/116; F21V 21/28; F21V 23/003; F21W 2131/105
USPC ..... 362/235, 147, 232, 230
See application file for complete search history.

(56) References Cited

U.S. PATENT DOCUMENTS

| | | | | |
|---|---|---|---|---|
| 6,250,596 | B1 | 6/2001 | Gordin et al. | |
| 6,446,408 | B1 | 9/2002 | Gordin et al. | |
| 7,246,918 | B2 * | 7/2007 | Ginsburg | F21S 8/086 362/145 |
| 7,500,764 | B2 | 3/2009 | Gordin | |
| D655,840 | S | 3/2012 | Heaton et al. | |
| 8,717,552 | B1 | 5/2014 | Gordin et al. | |
| 2011/0149582 | A1 | 6/2011 | McKee | |
| 2013/0250556 | A1 | 9/2013 | Gordin et al. | |

OTHER PUBLICATIONS

"Luminaire Classification System for Outdoor Luminaires", Illuminating Engineering Society, (2011), pp. 28-32. May 16, 2011.

(Continued)

*Primary Examiner* — Karl D Frech
(74) *Attorney, Agent, or Firm* — McKee, Voorhees & Sease, PLC

(57) ABSTRACT

Disclosed herein is a solution to installing a large number of lighting fixtures on a pole or other elevating structure in a manner that does not project light behind the pole/elevating structure, does not project light so to strike the pole/elevating structure and produce localized glare, does not produce uneven loading, and minimizes uncontrolled uplighting. Said solution is achieved, at least in part, by an envisioned tilted pole top fitter designed to offset rows of lighting fixtures to prevent both physical and photometric interference.

20 Claims, 20 Drawing Sheets

(56) References Cited

OTHER PUBLICATIONS

"Standard Specifications for Structural Supports for Highway Signs, Luminaires, and Traffic Signals", American Association of State Highway and Transportation Officials, Sixth Ed., (2013), 318 pages. Jan. 1, 2013.

* cited by examiner

APPARATUS, METHOD, AND SYSTEM FOR TILTED POLE TOP FITTER

CROSS-REFERENCE TO RELATED APPLICATIONS

This application claims priority under 35 U.S.C. § 119 to provisional U.S. application Ser. No. 62/160,317, filed May 12, 2015, hereby incorporated by reference in its entirety.

I. BACKGROUND OF THE INVENTION

The present invention generally relates to devices affixed to the top of a pole—what will be referred to herein as pole top fitters—which are adapted to orient, suspend, and/or otherwise positionally affix one or more objects relative said pole (or relative a target area, for example). More specifically, the present invention relates to the design and operation of pole top fitters as they relate to lighting fixtures; particularly in applications where uplight is to be avoided. Uplight, as it is commonly known in the industry—see, e.g., IES TM-15-11—is generally defined as light projected above a luminaire (assuming a luminaire pointing downwardly), and is later discussed.

A pole top fitter is not a new device or technology; its use has long been established in the art of wide area lighting; see, for example, U.S. Pat. No. 7,500,764 hereby incorporated by reference in its entirety. Pole top fitters provide a foundation for one or more extended armatures—what will be referred to herein as cross-arms—to which one or more lighting fixtures (or other objects) are affixed. As used herein, "lighting fixture" refers generally to a light source, associated housing, associated light directing and/or light redirecting devices, associated electrical connections, and associated devices for attaching to a cross-arm (if any); no distinction has been made between "luminaires" or "lighting fixtures", and indeed the terms are used interchangeably herein.

Pole top fitters permit a lighting designer to affix multiple luminaires to a single pole, thereby ensuring fewer poles are needed for a given lighting application. As is well known in the art, fewer poles translate to potential cost savings—which for a wide area lighting application (e.g., professional sports field) with poles on the order of several tens of feet tall can be substantial. There is a natural motivation, then, to pack as many fixtures and cross-arms on a pole top fitter as is possible for a given pole, each pole having a loading capacity in accordance with its size, material, processing techniques, mounting height, anticipated wind load for the geographic area, and the like. An overzealous approach to loading a pole top fitter (e.g., producing a greatly unbalanced or eccentric load on a pole to pack in more fixtures)—regardless of whether limitations for a given pole are exceeded—can sometimes result in warpage of the cross-arm or tipping of the pole. For that reason (and perhaps others), sometimes pole top fitters are configured in what will be referred to as a "back-to-back" configuration; namely, lighting fixtures on both sides of the pole and projecting light generally in opposite directions (i.e., forward of the pole and behind the pole). Placing fixtures in a back-to-back configuration on a pole top fitter may permit additional lighting fixtures to be installed on a single pole without bending the pole or warping a cross-arm, but can become problematic when (i) it is undesirable to project light behind a pole or (ii) the positioning of the fixtures on both sides of the pole inadvertently illuminates the pole itself (causing localized glare or otherwise distracting from the intended viewing target).

Returning now to the issue of uplight—the phenomenon of projecting light upwardly of a downwardly-facing lighting fixture can be undesirable for a number of reasons. Generally speaking, any light not directed towards a target area is wasted—lowering the overall efficiency of the lighting system and contributing to sky glow. Sky glow is particularly undesirable in residential areas, areas designated as "dark sky"—see, e.g., www.darksky.org for areas designated as such according to the International Dark-Sky Association—or areas having conservatories, for example. Of course, some lighting applications prefer some degree of uplighting—in particular, aerial sports such as baseball, golf, volleyball, and ski jumping—but in such cases it is desirable for uplighting to be precise and controlled.

In the context of pole top fitters, uplight becomes a concern when a lighting designer attempts to stack multiple rows of lighting fixtures on a pole. The light from a fixture on the top row may strike the housing of a lighting fixture on a lower row and redirect it in a number of directions, producing specular or diffuse reflection depending on environmental conditions, housing material, and the like. This redirected light produces uncontrolled uplight and is undesirable. One solution is to offset lighting fixtures, but this may reduce the fixture count on a pole—which is undesirable. The fixtures could be placed in a back-to-back configuration on the pole top fitter, but this places light behind the pole—which may be undesirable. Additionally, if the fixtures on the back side of a pole in a back-to-back configuration are re-aimed so to attempt to project all light forward of the pole, there is a high likelihood that some of that re-aimed light will strike the pole itself, thereby creating small scale or localized glare—which is undesirable, and may also contribute to uncontrolled uplight. The entire pole top fitter could be angled relative the pole—much like photo finish lighting fixtures for some race tracks—but this configuration is impractical for a large number of fixtures (e.g., because of the risk of pole tipping). The art lacks a solution to providing a large number of fixtures on a pole top fitter in a manner that does not project light behind the pole, does not produce uneven loading, and minimizes uncontrolled uplighting and/or localized glare.

Thus, there is room for improvement in the art.

II. SUMMARY OF THE INVENTION

In the art of lighting—particularly wide or large area lighting (e.g., sports lighting)—it is often desirable to add as many lighting fixtures as possible per pole to minimize the number of poles (and therefore reduce cost) for a given lighting application. Where this becomes problematic is when so many lighting fixtures are added per pole top fitter that the fixtures interfere with one another—either physically (e.g., aiming angles are precluded because fixtures would bump into each other) or photometrically (e.g., when light from one fixture strikes another). Prior art approaches to preventing interference from luminaires on the same pole top fitter (e.g., tipping the entire fitter, back-to-back configuration of fixtures) are insufficient. In some cases, prior art approaches are not structurally sound for a large number of lighting fixtures typically needed for wide or large area lighting; in other cases, prior art approaches do not permit the projecting of light in a desirable fashion.

It is therefore a principle object, feature, advantage, or aspect of the present invention to improve over the state of the art and/or address problems, issues, or deficiencies in the art.

Envisioned is a pole top fitter designed to (i) prevent both physical and photometric interference between luminaires mounted on the same pole, whether on the same cross-arm or on separate cross-arms; (ii) ensure a balanced or stabilized load, particularly when compared to prior art approaches; and (iii) prevent unwanted uplight or localized glare.

Further objects, features, advantages, or aspects of the present invention may include one or more of the following:

a. a method of lighting design which employs one or more of said envisioned pole top fitters to project all light in a desirable and controlled fashion; and
b. means to modularize said envisioned pole top fitter to:
   i. enable the adding or removing of lighting fixtures after installation at a site; and
   ii. aid in the manufacturing of a lighting system based on the aforementioned lighting design.

These and other objects, features, advantages, or aspects of the present invention will become more apparent with reference to the accompanying specification and claims.

III. BRIEF DESCRIPTION OF THE DRAWINGS

From time-to-time in this description reference will be taken to the drawings which are identified by figure number and are summarized below.

FIGS. 1A and B illustrate a balanced/structurally sound loading condition for a typical elevated outdoor lighting system. FIGS. 1C and D illustrate an unbalanced/potentially structurally unsound loading condition for a typical elevated outdoor lighting system.

FIGS. 2A-D illustrate a typical outdoor lighting application. FIG. 2A illustrates the installation from an elevated perspective view during the day, FIG. 2B illustrates the installation from a spectator view during the day, FIG. 2C illustrates the spectator view from FIG. 2B during the night, and FIG. 2D illustrates the nighttime spectator view from FIG. 2C according to at least one aspect of the present invention.

Figure 3:
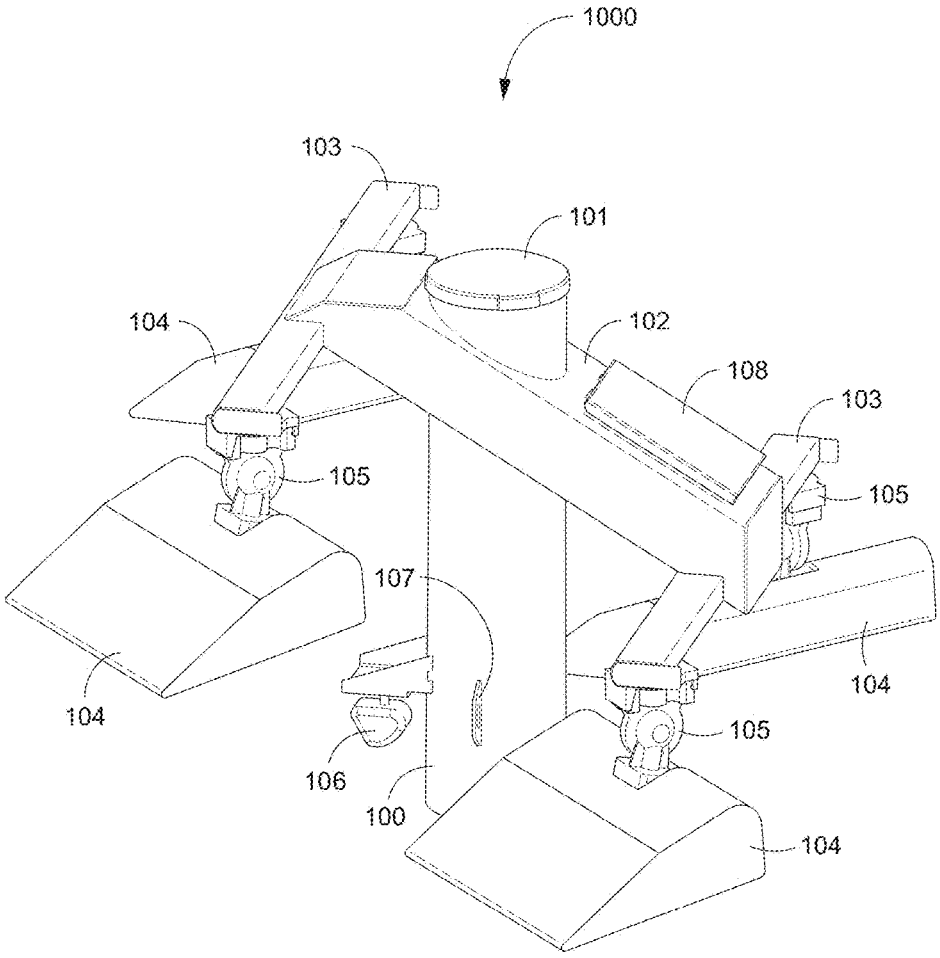
FIG. 3 illustrates an isolated perspective view of a pole top fitter assembly according to at least one aspect of the present invention.
Figure 4:
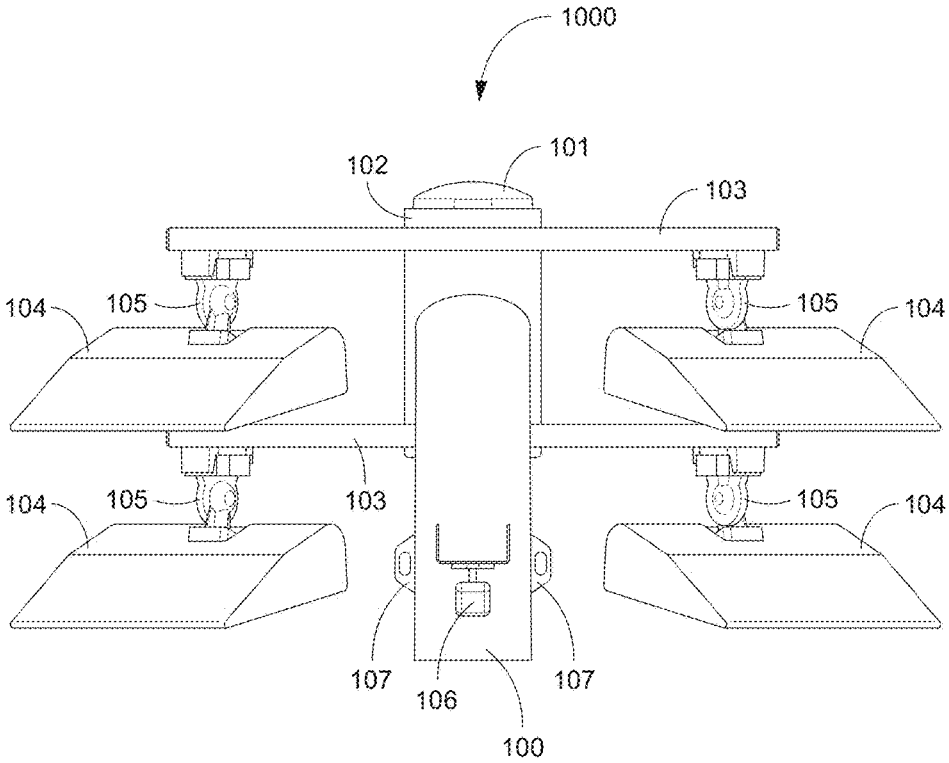
FIG. 4 illustrates a front view of the pole top fitter assembly of FIG. 3.
Figure 5:
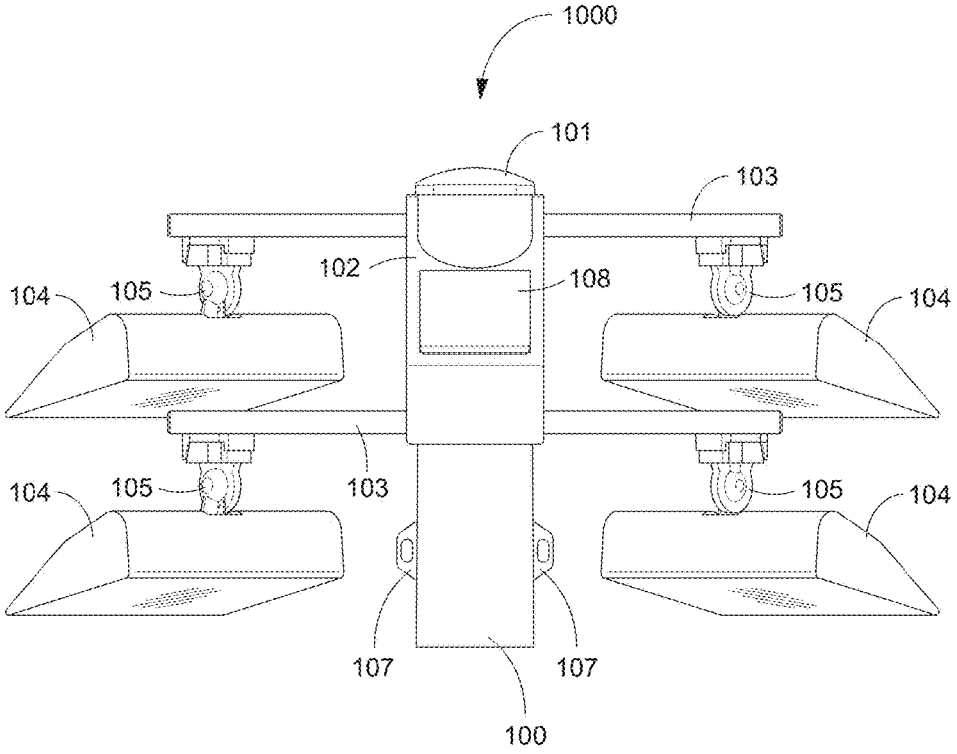
FIG. 5 illustrates a back view of the pole top fitter assembly of FIG. 3.
Figure 6:
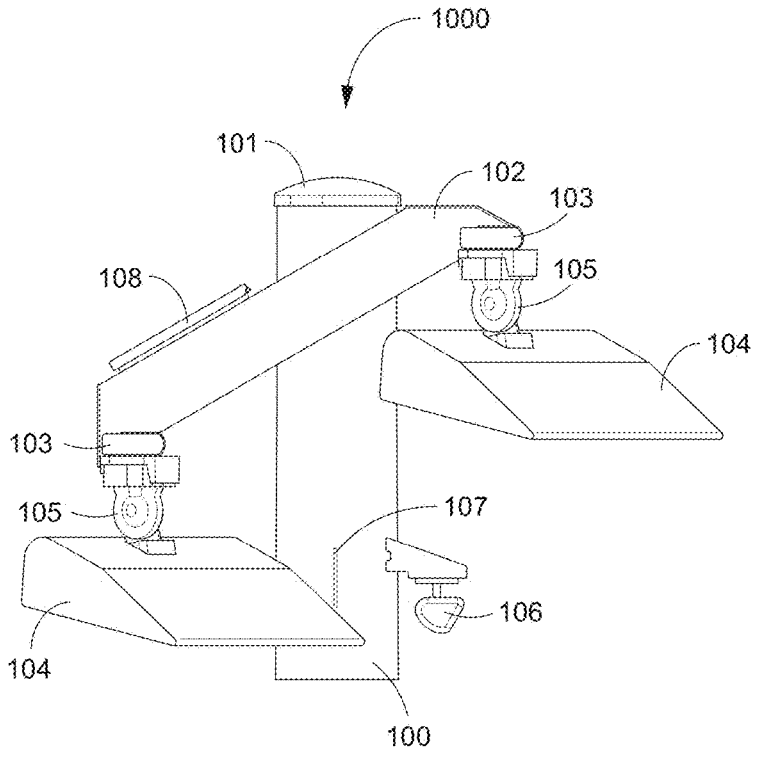
FIG. 6 illustrates a left side view of the pole top fitter assembly of FIG. 3.
Figure 7:
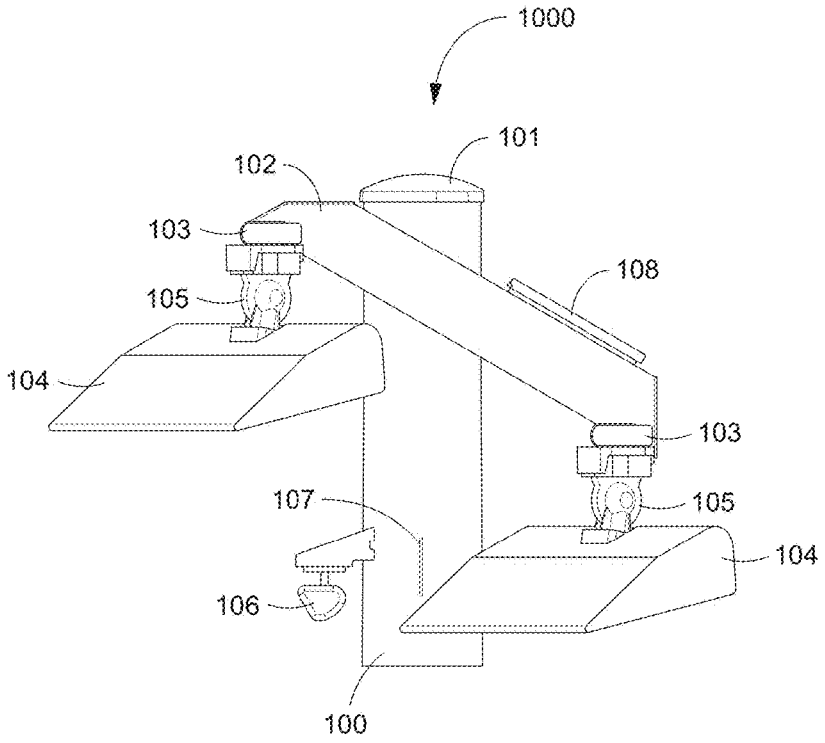
FIG. 7 illustrates a right side view of the pole top fitter assembly of FIG. 3.
Figure 14A:
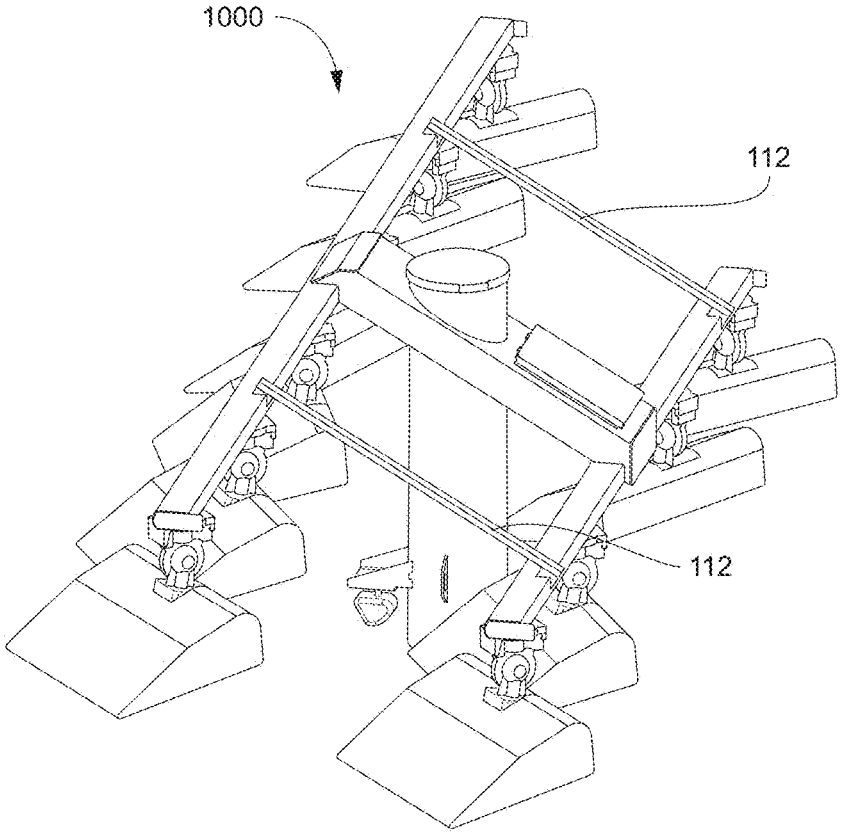

FIGS. 14A and B illustrate perspective and top views, respectively, of a similar configuration to the pole top fitter assembly of FIG. 3 but including one or more spreader bars 112 to accommodate additional devices (e.g., fixtures 104).

Figure 15:
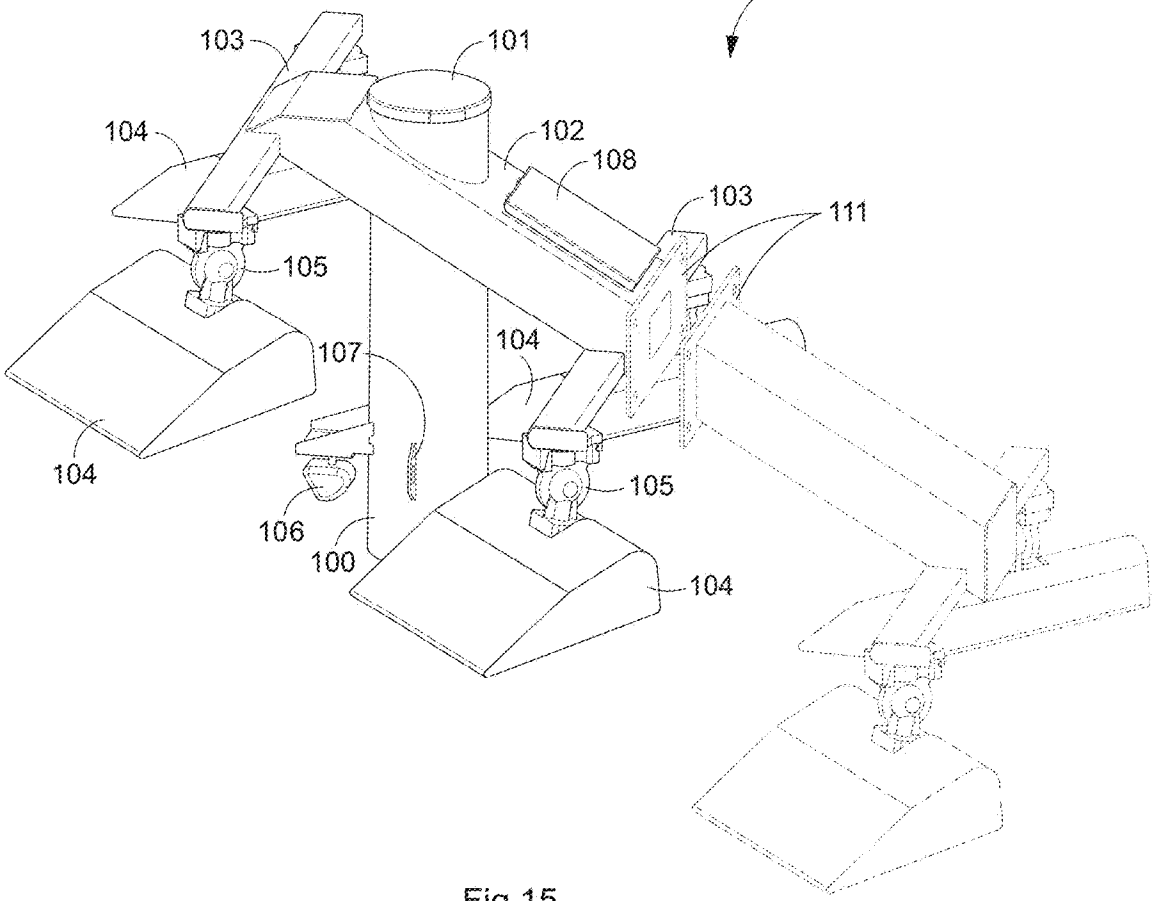

FIG. 15 illustrates the pole top fitter assembly of FIG. 3 as modified to include a mounting plate 111 at the end of center cross-arm support 102 according to another possible alternative.

Figure 16A:
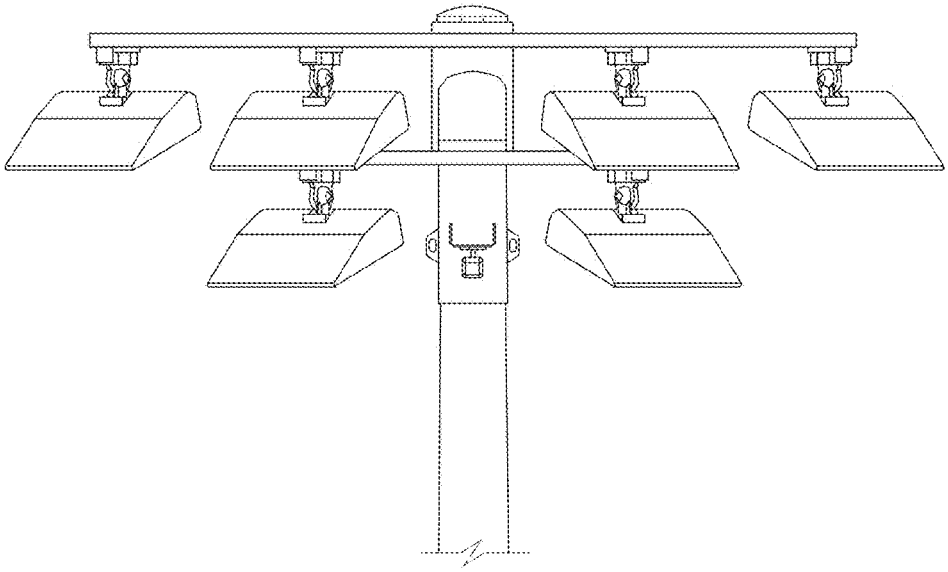
Figure 16B:
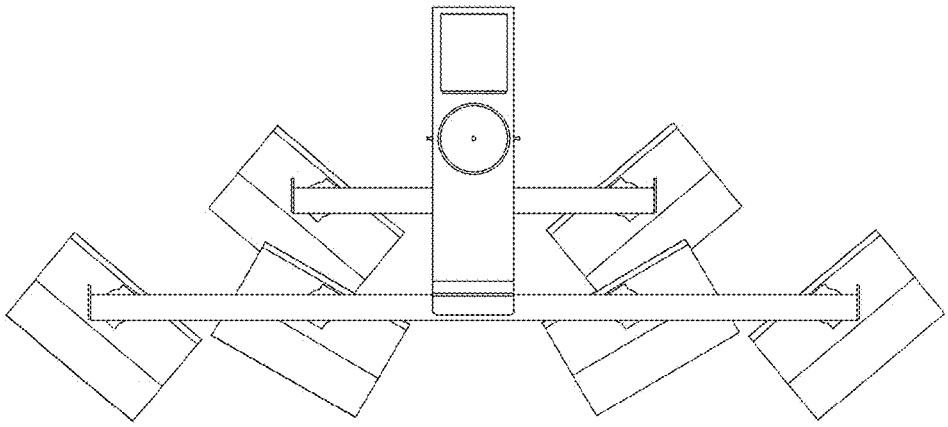

FIGS. 16A and B illustrate the typical elevated outdoor lighting system from FIGS. 1 A and B with the cross-arms shifted to the front of the pole for select operating conditions.

IV. DETAILED DESCRIPTION OF EXEMPLARY EMBODIMENTS

A. Overview

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Regarding terminology, as has already been stated the terms "luminaire" and "fixture" are used interchangeably herein; either term is generally intended to comprise a light source, associated housing, associated light directing and/or light redirecting devices, associated electrical connections, and associated devices for attachment to a cross-arm (if any). In the context of the aforementioned, a "light source" could be a single light source (e.g., 1500 W metal halide lamp) or several light sources (e.g., any of the XLamp model LEDs available from Cree, Inc., Durham, N.C., USA). "Light directing" devices are generally understood to comprise devices common to lighting design that position, orient, or otherwise direct light; some examples include secondary lenses on LEDs or structural components like adjustable armatures. "Light redirecting" devices are generally understood to comprise devices common to lighting design that absorb, reflect, or in both ways modify light; some examples include reflectors or light absorbing baffles.

Figure 1A:
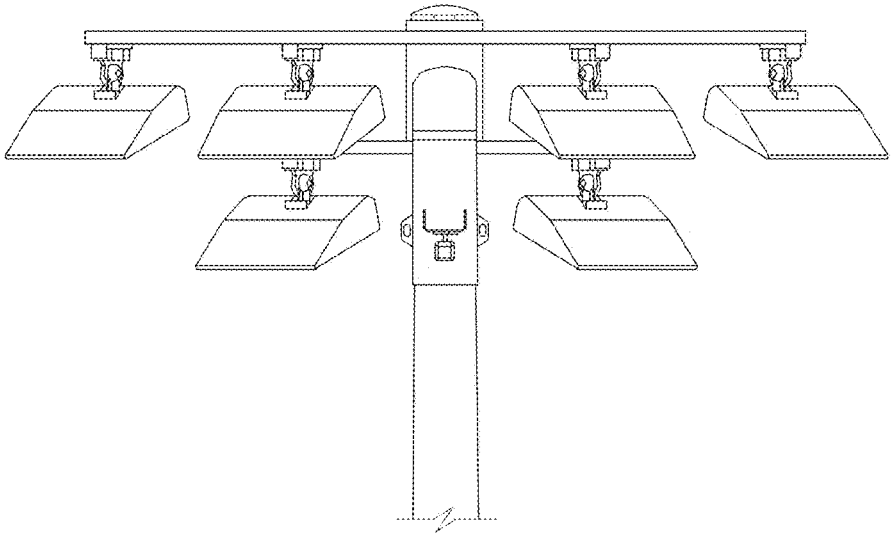
Figure 1B:
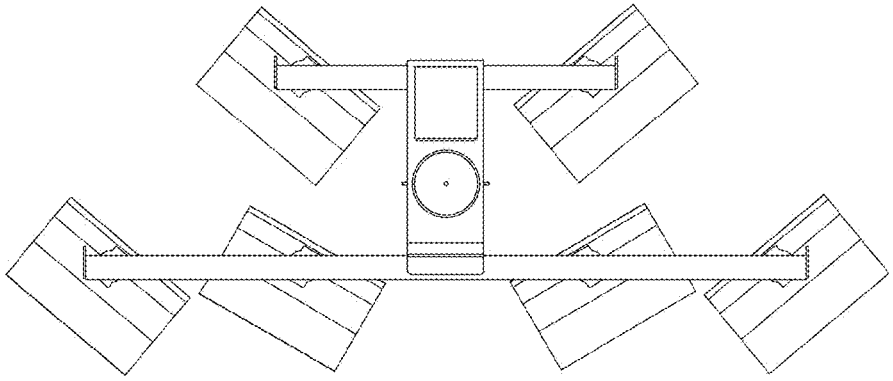
Figure 1C:
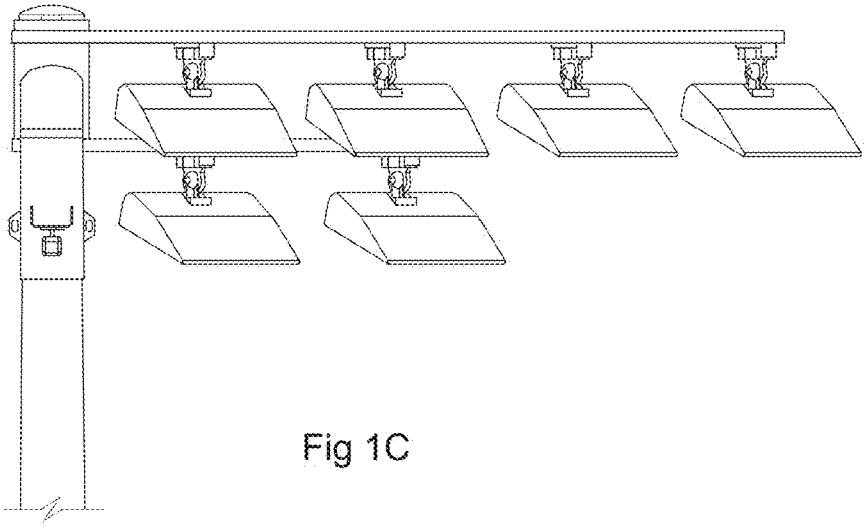
Figure 1D:
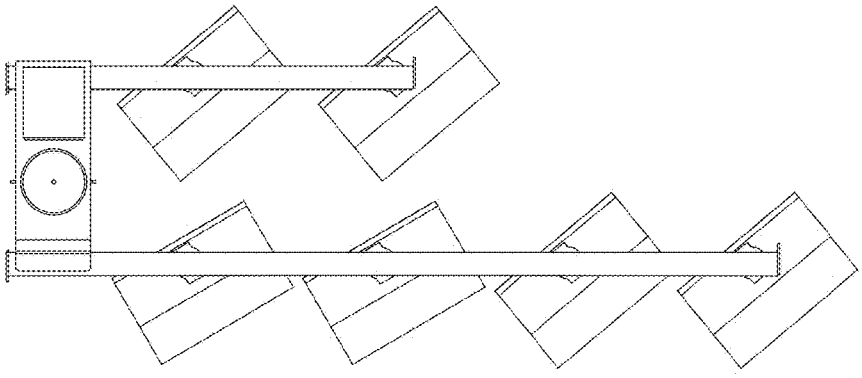

Further regarding terminology, reference herein has been given to the terms "balanced" or "stabilized"—particularly with respect to devices on the top of poles (i.e., pole top fitters) to which one or more objects (e.g., luminaires) are affixed. It should be noted that as discussed herein, balance or stability refers either to a structural consideration (e.g., eccentric loading), an aesthetic consideration (e.g., eccentric visual), or both—where "eccentric" describes something (structurally or aesthetically) as being off from a central axis. A specific example of the former would include a modification of a torque calculation on a vertical support when the load is unbalanced (see, for example, FIG. 3.9.4.2-1 of the Standard Specifications for Structural Supports for Highway Signs, Luminaires, and Traffic Signals (Sixth Edition, 2013) published by the American Association of State Highway and Transportation Officials (AASHTO) hereby incorporated by reference in its entirety). A specific example of the latter would include a design such as is illustrated in FIGS. 1A-D. FIGS. 1A and B illustrate what would be considered a lighting design which presents a substantially balanced visual, whereas FIGS. 1C and D illustrate a lighting design which presents an eccentric visual—the latter design is generally understood to be undesirable regardless of whether it is structurally stable or functional. It is important to note that aesthetics and functionality are both considered critical design considerations in elevated structures (e.g., poles) with one or more objects affixed thereto; see, for example, Section 2 of the aforementioned incorporated AASHTO standard.

Figure 2A:
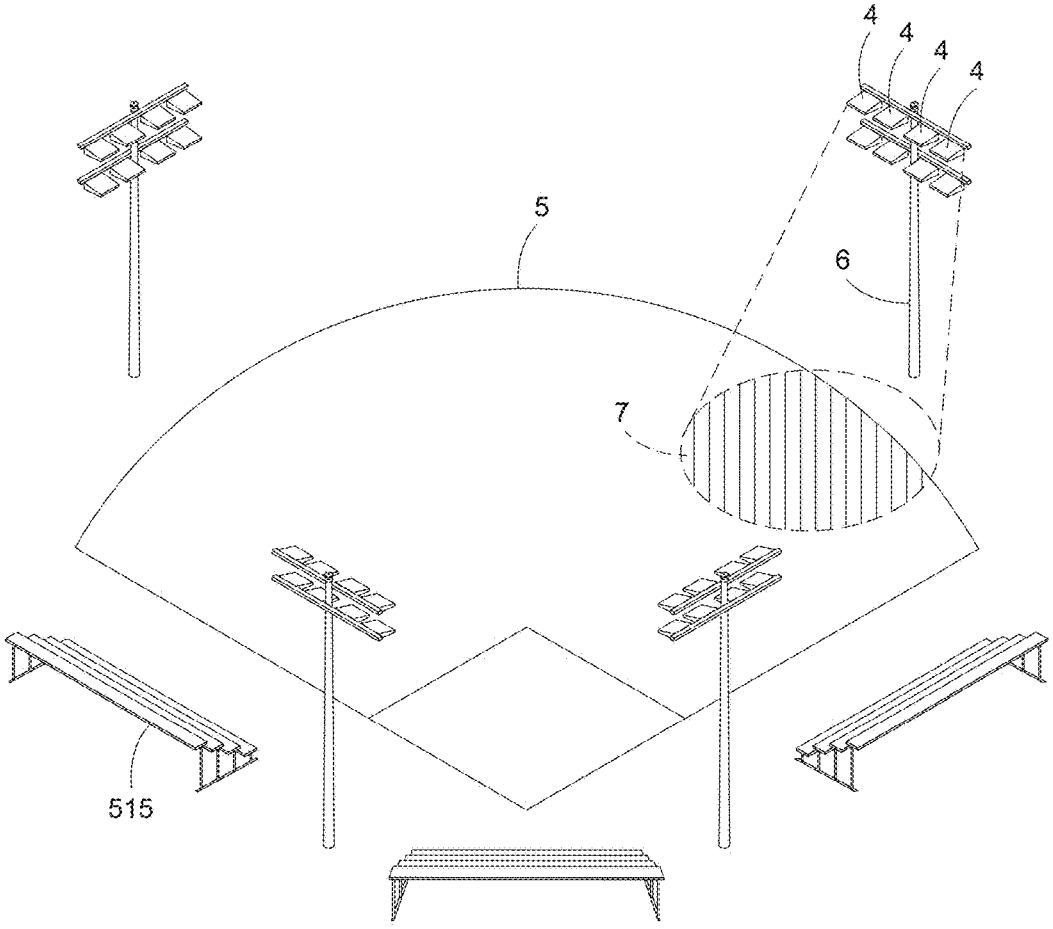
Figure 2B:
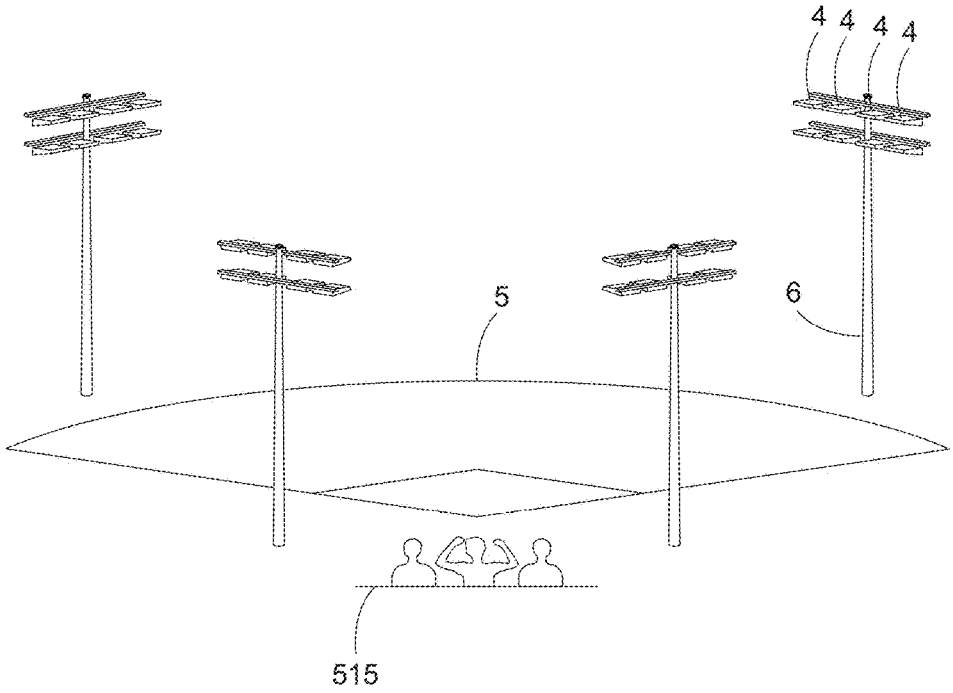
Figure 2C:
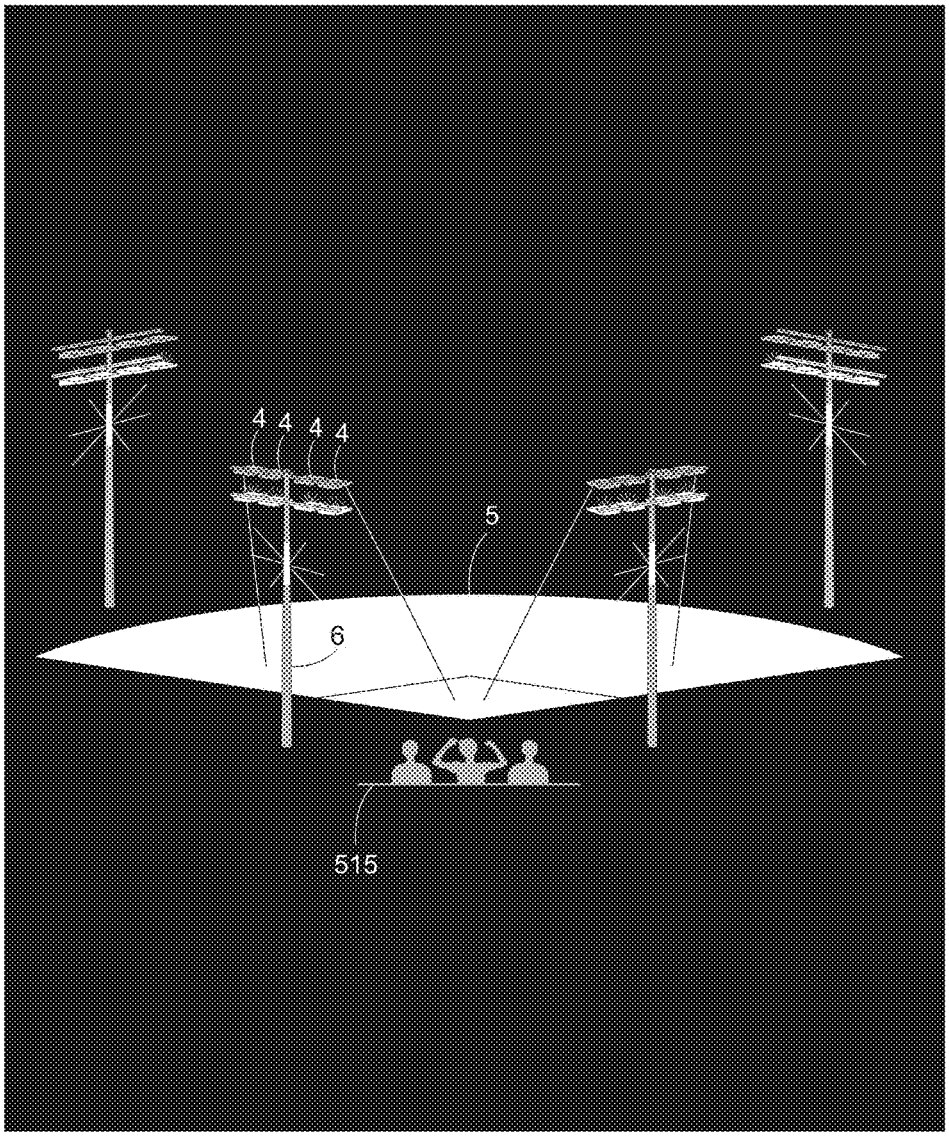

Further regarding terminology, reference herein has been given to the terms "localized glare" and "small scale glare"—particularly with respect to any inadvertent or unintentional lighting of a portion of the pole or other elevating structure. Either term is generally intended to reference the lighting of something other than the target area (e.g., the field of play, a space above the field of play (e.g., for aerial sports), and a space adjacent to the field of play (e.g., for player benches)) that is in a particular field of view (often a spectator's); there is no intent to delineate between discomfort glare and disability glare, nor is there any intent to quantify or analyze the glare from inadvertent or unintentional lighting of the pole. This "small scale glare" is perhaps best described via the illustrations in FIGS. 2A-D. As can be seen, a target area 5 is illuminated 7 by one or more lighting fixtures 4 affixed to a pole 6; here, the top row of lighting fixtures 4 on each pole 6 is affixed to the front side of the pole (i.e., the side generally proximate the target area) and the bottom row of lighting fixtures 4 on each pole 6 is affixed to the back side of the pole (i.e., the side generally distal the target area). Note that for clarity only one pole is labeled, only four luminaires are labeled, and light is depicted diagrammatically as dotted lines where the hatched portion indicates desired illumination and the unhatched portion indicates undesired illumination (for some instances). A number of spectators are typically seated on bleachers 515. During a daytime condition (FIG. 2B) luminaires 4 are not typically on, and if so, do not cause small scale glare because of the high ambient illuminance. During a nighttime condition (FIG. 2C) lighting fixtures 4 are on and generally aimed so to illuminate target area 5; here illumination is indicated by a light area generally the size of target area 5, lines directed from the fixtures to the field (for clarity only two fixtures include such lines), and a "sparkle" or "dazzle" at each pole 6. These "sparkle" or "dazzle" shapes in FIG. 2C are visual aids designed to indicate the general location and distracting nature of small scale glare; here, caused by fixtures mounted on the back side of the pole (e.g., in a back-to-back configuration) that are aimed forward of the pole. For a spectator in stands 515 it is generally desirable to see the field and not be distracted by localized glare caused by inadvertent or unavoidable lighting of the pole by the fixtures.

While additional discussion could be had regarding localized glare and glare in general, for purposes of the present invention it is sufficient to note that (i) any light source or surface which reflects light can produce glare, (ii) glare sources in a field of view detract from the viewing of the target area, and (iii) glare sources are generally undesirable for lighting design for a number of typical viewing angles (such as a line-of-sight from a position in spectator bleachers towards the center of a playing field). Additional details can be found in, e.g., Clear, R D. Discomfort glare: What do we actually know? Lighting Research & Technology 2012; 0: 1-18, hereby incorporated by reference in its entirety.

Figure 2D:
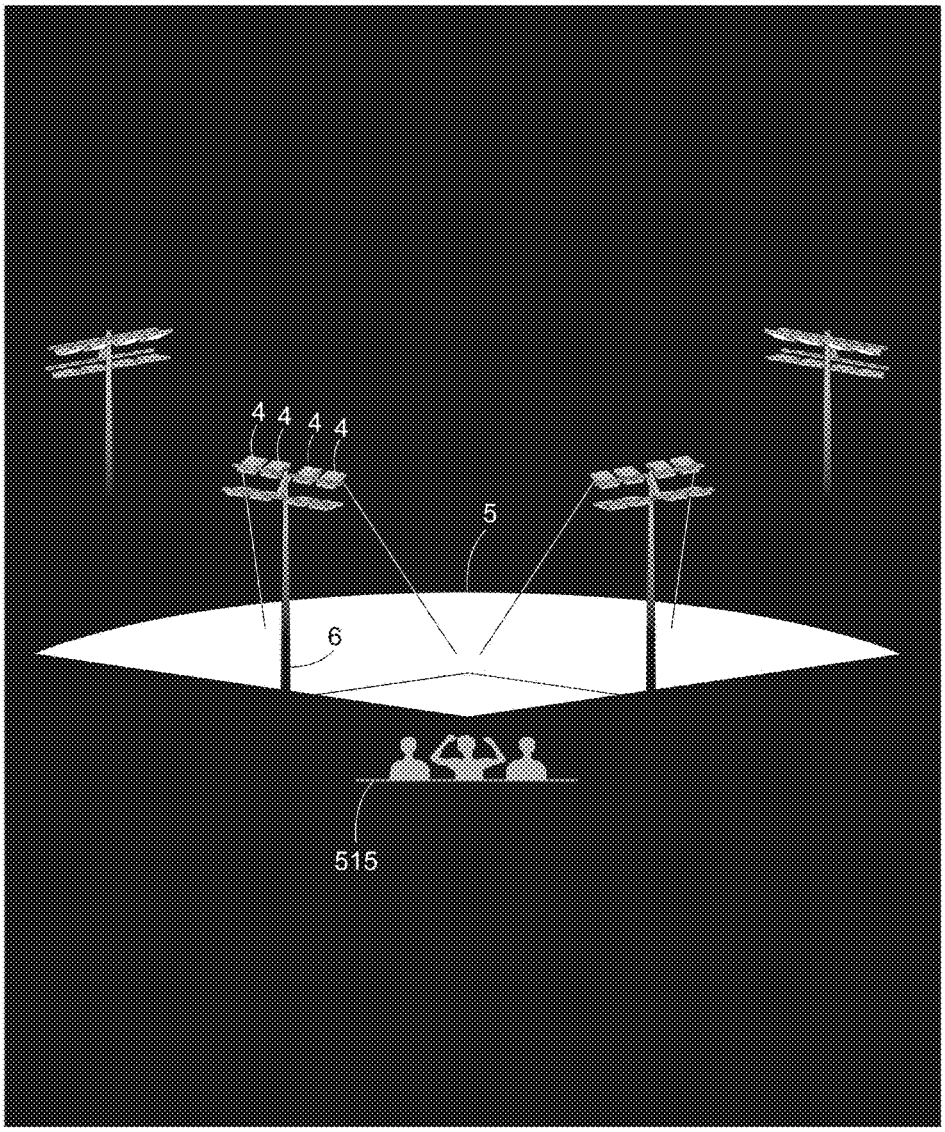

Lastly, while a more specific description of the general example illustrated in FIG. 2D is as follows, it should be noted that the aforementioned terminology has been provided by way of example, and not by way of limitation. For example, while the aforementioned terminology has been presented with respect to lighting fixtures, elevating structures such as poles could employ pole top fitters to which objects other than lighting fixtures are affixed, and yet not depart from aspects according to the present invention; speakers and cameras are two possible examples.

B. Exemplary Method and Apparatus Embodiment 1

FIGS. 3-9 illustrate an exemplary apparatus which may be used in the scenario of FIG. 2D, wherein the exemplary apparatus includes a pole top fitter designed so to balance both loading and aesthetics while providing directional lighting forward of a pole in a manner that does not produce localized glare or uncontrolled uplight. As can be seen from FIG. 3, a pole top fitter assembly 1000 comprises a fitter shaft 100 which is designed to maintain alignment with and slip fit over a pole section or other elevating structure via come-alongs or other devices in conjunction with jacking ears 107; slip-fit pole assembly is well known in the art (see, e.g., U.S. Pat. No. 6,446,408 hereby incorporated by reference in its entirety) and so such details are not illustrated in the Figures, and no additional discussion is provided. Fitter shaft 100 has an outer diameter on the order of several inches, a wall thickness on the order of ⅛ inch, and could be formed from a number of materials—though for typical outdoor use, it would be beneficial for fitter shaft 100 to be formed from a material that is electrically conductive (e.g., to aid in providing a low impedance path to ground in the event of electrical strike), readily formed (e.g., to aid in forming tapered sections for slip fits, for economic production of tubing), and corrosion resistant. For the specific example illustrated in FIGS. 3-9, fitter shaft 100 (and potentially other parts such as center cross-arm support 102 and cross-arms 103) is formed from ASTM A513 grade MT 1010 tubing, though this is by way of example and not by way of limitation.

A center cross-arm support 102 is welded or otherwise affixed to fitter shaft 100 (or directly to a pole) at or near the top of the elevating structure (i.e., at or near the end furthest from the ground)—but at an angle—so to support cross-arms 103 on either side which, in turn, support one or more devices; in this example, lighting fixtures 104 and associated adjustable armatures 105. Center cross-arm support 102 can be constructed in a variety of ways. One example is basically a square tubular metal main body. Apertures basically matching the form factor of fitter shaft 100 (in particular its shape in a cross-sectional plane that is angled relative to its longitudinal axis such as shown in FIG. 3) would be formed in the top and bottom surfaces of center cross-arm support 102. This would allow center cross-arm support 102 to be welded in fixed position as shown in FIG. 3. The junctions between shaft 100 and support 102 can be sealed.

There are a number of benefits to constructing fitter shaft 100 and center cross-arm support 102 in such a fashion. Firstly, by employing a single center cross-arm support instead of two center cross-arm supports (as would be the case in a typical back-to-back configuration) the number of parts and assembly steps during production/manufacturing are reduced. Next, by welding center cross-arm support 102 to fitter shaft 100 at an angle—here 30°—the angle of support 102 relative horizontal is fixed and will not inadvertently come out of alignment during shipping or during the factory aiming of lighting fixtures (see, e.g., U.S. Pat. No. 8,717,552 hereby incorporated by reference in its entirety). Further, by selecting a length of center cross-arm support—here on the order of 40 inches—in combination with the angle of the center cross-arm support relative horizontal—again, 30°—a lighting designer can ensure that lighting fixtures on one cross-arm 103 (upper left side of the page of FIG. 3) will not physically interfere with lighting fixtures on the other cross-arm 103 (lower right side of the page of Figure)—because at all times lighting fixtures are co-located relative a common feature (i.e., center cross-arm support 102) which is specifically designed to prevent physical and photometric interference—this is not the case with traditional back-to-back configurations.

The aforementioned 30° angle was determined to be optimal from empirical observations—a much lower angle (i.e., closer to horizontal) resulted in either photometric interference or localized glare at typical sports lighting aiming angles, and a much higher angle (i.e., closer to vertical) resulted in an unbalanced aesthetic. That being said, if desired (e.g., if lighting fixtures 104 were of a different design or had a different panning angle, or if objects other than lighting fixtures were attached to cross-arms 103) other angles could be used. "Typical" sports lighting aiming angles vary from sport to sport and fixture to fixture, but for the fixture illustrated in FIGS. 3-9—and discussed in greater detail in U.S. Patent Publication No. 2013/0250556 hereby incorporated by reference in its entirety—typical aiming angles were on the order of 0-35° vertically (i.e., tilting) and 0-150° horizontally (i.e., panning). The aforementioned 40 inches was determined as a result of a number of factors. First, the number of anticipated fixtures in combination with expected pan and tilt angles was considered. The length, angle, and material selection (ASTM A513 grade MT 1010 tubing) of center cross-arm support 102 was designed so to accommodate anywhere from six fixtures of the type illustrated in FIGS. 3-9 (four on the upper/front cross-arm 103 (i.e., upper left side of the page of FIG. 3) and two on the lower/back cross-arm 103 (i.e., lower right side of the page of FIG. 3)) to seventeen fixtures of the type illustrated in FIGS. 3-9 (nine on the upper/front cross-arm 103 (i.e., upper left side of the page of FIG. 3) and eight on the lower/back cross-arm 103 (i.e., lower right side of the page of FIG. 3))—though once ten or more fixtures are included in the design a pair of spreader bars will likely need to be employed to ensure stability (see FIGS. 14A and B, later discussed). Of course, lighting fixtures (or other objects) could be divvied up between the upper/front and lower/back sides of center cross-arm support 102 in a number of different ways—but to maintain a balanced visual aesthetic (i.e., a larger set of fixtures at the top which taper down and therefore balance the pole which is larger at the bottom and tapers to the top), a relatively balanced load on the pole, and to ensure there is no light projected onto the pole itself, the configurations in Table 1 are preferred.

TABLE 1

| Total Fixtures | Fixtures on Upper/Front of Part 102 | Figures on Lower/Back of Part 102* |
|---|---|---|
| 6 | 4 | 2 |
| 7 | 5 | 2 |
| 8 | 4 | 4 |
| 9 | 5 | 4 |
| 10 | 6 | 4 |
| 11 | 7 | 4 |
| 12 | 6 | 6 |
| 13 | 7 | 6 |

TABLE 1-continued

| Total Fixtures | Fixtures on Upper/Front of Part 102 | Figures on Lower/Back of Part 102* |
|---|---|---|
| 14 | 8 | 6 |
| 15 | 9 | 6 |
| 16 | 8 | 8 |
| 17 | 9 | 8 |

Figure 8:
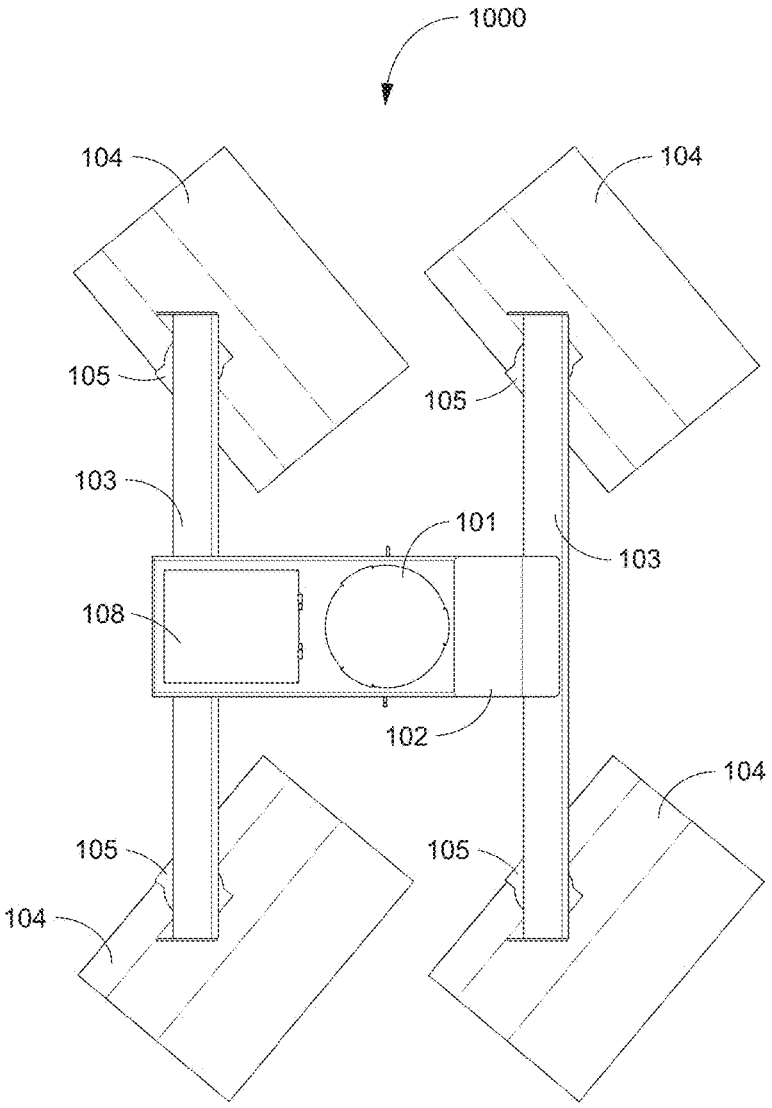
FIG. 8 illustrates a top view, rotated 90° counter-clockwise, of the pole top fitter assembly of FIG. 4.
Figure 9:
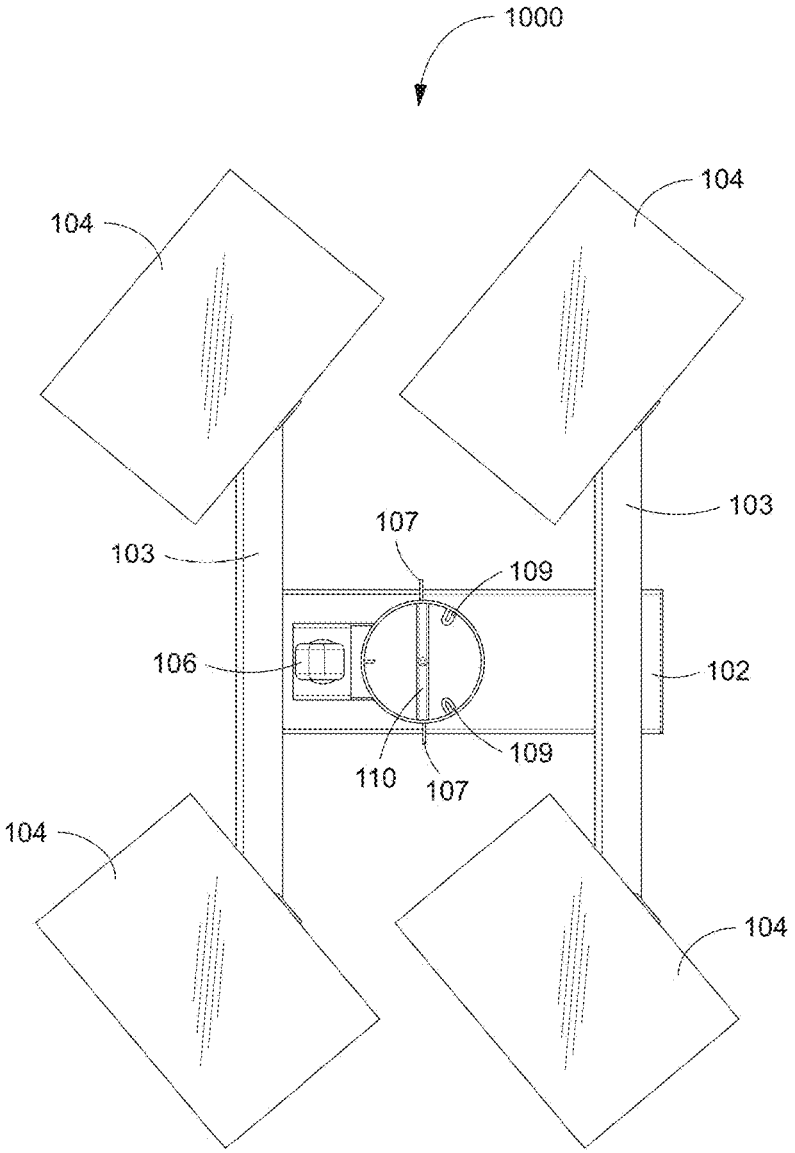
FIG. 9 illustrates a bottom view, rotated 90° counter-clockwise, of the pole top fitter assembly of FIG. 4.

*Fixture spacing must be such that no fixtures are placed directly behind the pole As envisioned, fitter shaft 100, center cross-arm support 102, cross-arms 103, and adjustable armatures 105 are substantially hollow; this permits wiring for fixtures 104 to be run from a distribution source up a hollow pole, into fitter shaft 100, along center cross-arm support 102, into cross-arms 103, through adjustable armatures 105, and to the luminaires. An example of an adjustable armature which could be used in FIGS. 3-9 is illustrated and discussed in U.S. Patent Publication No. 2011/0149582 hereby incorporated by reference in its entirety. If desirable, fitter cap 101 could be removable—yet secured to a bracket 110 (FIG. 9) so to prevent a safety hazard if dropped from an elevated position—such that said wiring could be provided with some degree of strain relief by looping or hanging the wiring on hooks 109. Alternatively, power could be provided to fixtures 104 using sections of wiring rather than one continuous run of wire. A first section of wiring could be run from a distribution source to a first set of connectors supported at hooks 109, and a second section of wiring run from connectors at hooks 109 to an intermediate area within center cross-arm support 102 accessible from a panel 108 (FIG. 8). This configuration is particularly useful if lighting fixtures 104 contain multiple light sources such as LEDs. Drivers or other power regulating components could be housed in the internal cavity of center cross-arm support 102 and accessible from panel 108, lending significant flexibility in how fixtures are wired and operated (e.g., entire fixtures run in parallel or series, certain rows of LEDs within certain fixtures run in parallel or series), as well as simplifying the overall wiring process (as compared to traditional back-to-back configurations) by centrally housing and landing all wiring. In practice, the precise design of pole top fitter assembly 1000 can vary or include a number of options and alternatives; some are later discussed.

Figure 10:
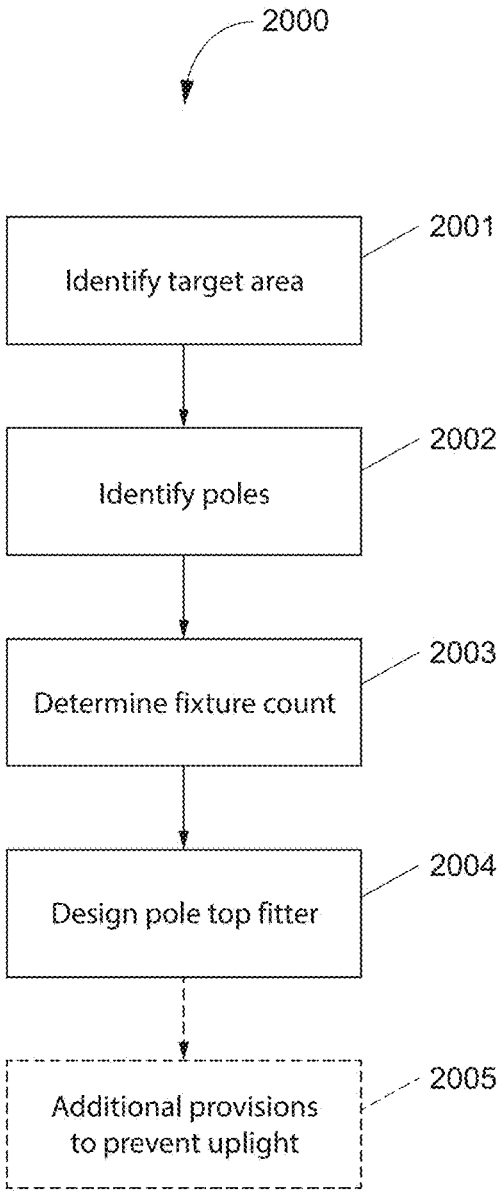
FIG. 10 illustrates a method of lighting design according to at least one aspect of the present invention.

A method of lighting design which employs a plurality of said envisioned pole top fitters to project all light in a desirable and controlled fashion may be as is illustrated in FIG. 10. A first step 2001 of method 2000 comprises identifying one or more target areas to be illuminated. In practice, some considerations may include identifying a "main target area"—an area requiring direct light, more intense light, or more uniform light—such as an infield of a baseball field; one or more "supplemental target areas"—one or more areas that require indirect light, less intense light, or less uniform light—such as an outfield of a baseball field; any areas also of interest but perhaps outside of the plane or general location of the main target area—such as a space above both the infield and outfield of a baseball field or the first several rows of spectator seating; and the various lighting metrics (e.g., minimum horizontal illuminance) which may be required or desired for the lighting application.

A second step 2002 comprises identifying poles for the lighting application roughly defined according to step 2001. In practice, the information from step 2001 may be necessary for or beneficial to step 2002. For example, step 2001 may yield information about geographic area that informs what kind and how much corrosion protection to include for poles, or anticipated wind loads which could, in part, determine pole wall thickness or processing steps. Some additional considerations may include identifying pole heights and locations (e.g., pole height and setback from the outfield line of a baseball field)—which could be informed, at least in part, by local building codes, existing structures, aesthetics, or otherwise.

A third step 2003 comprises determining fixture count for the lighting application given the information yielded in steps 2001 and 2002. In practice, some considerations may include horizontal and vertical aiming angles, as well as type of fixture and number/nature of light sources contained therein. Different pole locations and heights will require different aiming angles so to adequately light the target area. For the aforementioned example of a baseball field, the poles near the outfield will require the largest pan (i.e., horizontal aiming angle), and any array of lighting fixtures (or fixture within an array) aimed to light a portion of the target area near the base of its own pole will require the largest tilt (i.e., vertical aiming angle). Larger, heavier fixtures with more capacity for producing light could be used, but would perhaps necessitate a larger pole. Structural loading for poles might be limited by poor soil conditions; poles may not even be used in some lighting applications. If a pre-existing elevating structure is used (e.g., truss of a clubhouse roof proximate the baseball field), larger, heavier fixtures may not be an option. Alternatively, a lighting designer may choose to use smaller, lighter fixtures with less capacity for producing light—and in greater number—because spreading those fixtures across all the poles ensures more even lighting. All of the aforementioned are valid considerations according to step 2003.

A fourth step 2004 comprises designing the pole top fitters given the information yielded in steps 2001-2003. Here the benefits of a tilted pole top fitter are apparent: step 2001 dictates how much of an area (in all three dimensions) need to be illuminated, and to what level; step 2002 places restrictions (in all three dimensions) on where luminaires can exist so to provide the needed light level; step 2003 places restrictions on which configurations of light source, housing, light directing devices, light redirecting devices, and armatures can be used to provide the needed light level in the needed places from the acceptable mounting positions; and according to step 2004, all the restrictions of the previous steps are coordinated in a fashion that balances loading on a pole while providing directional lighting forward of the pole, and in a manner that prevents uncontrolled uplight, prevents localized glare, and presents a balanced aesthetic.

Figure 11:
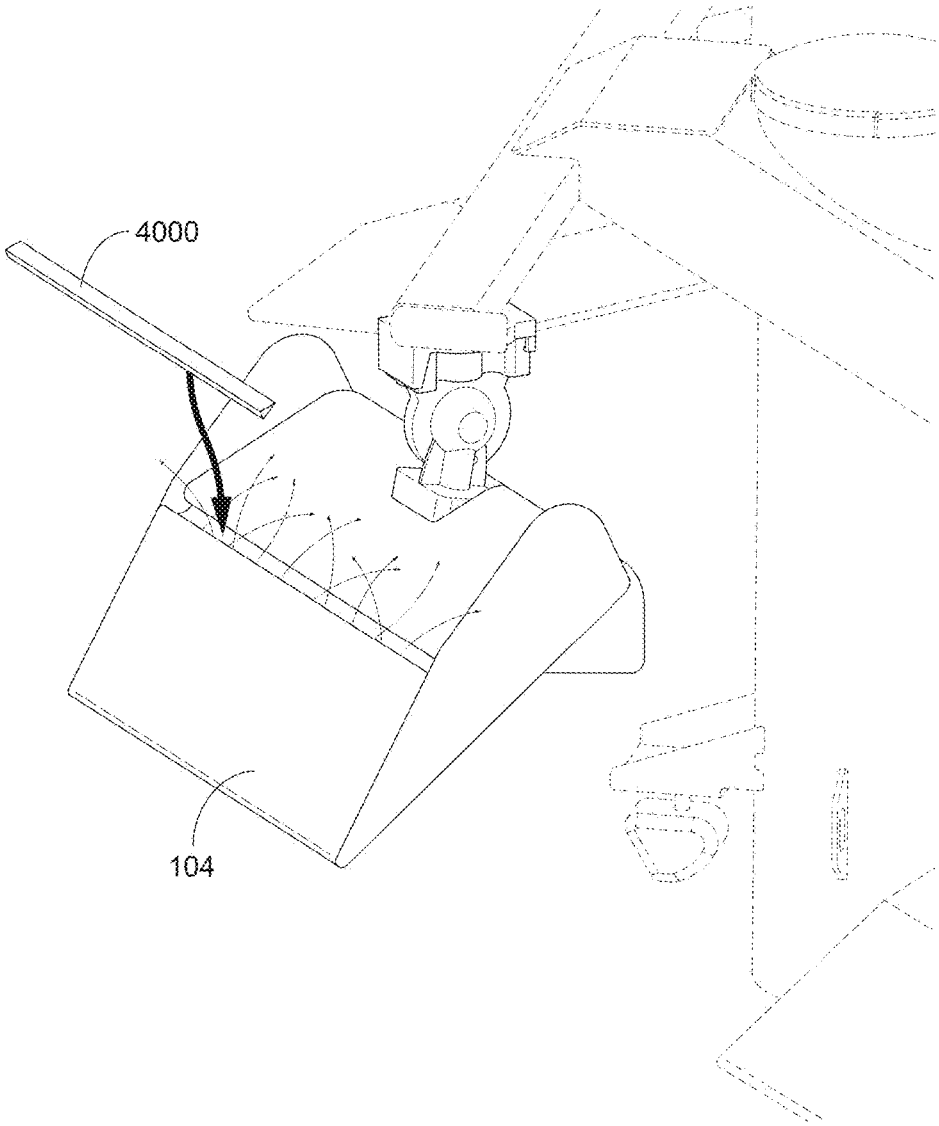
FIG. 11 illustrates one possible situation which may warrant additional uplight prevention provisions according to step 2005 of method 2000 of FIG. 10.

If fixture 104 has independently pivotable components—such as is described in aforementioned U.S. Patent Publication No. 2013/0250556—some uncontrolled uplighting (diagrammatically illustrated by lightweight arrows) may exist at the pivot point—see the heavy arrow in FIG. 11. If desired, optional step 2005 could comprise inserting a strip of light-absorbing material 4000 (e.g. black plastic, painted metal, or other strip material) in the gap (indicated at the heavy arrow in FIG. 11) after both the housing and external visor aiming angles are set. Of course, if aiming angles are pre-set and pole top fitter assembly 1000 is assembled at the factory prior to shipping to a site, there is an opportunity to address optional step 2005 prior to actual installation. In such an instance some or all of method 2000 may occur off site. In practice, an entire pre-aimed pole top fitter assembly 1000 could be shipped to a site, elevated (e.g., via crane) and installed on a pole, and then rotated until the entire assembly is in a correct operational orientation (e.g., by aligning a beam from laser aiming device 106 to a known point on the target area).

C. Options and Alternatives

The invention may take many forms and embodiments. The foregoing examples are but a few of those. To give some sense of some options and alternatives, a few examples are given below.

Figure 12:
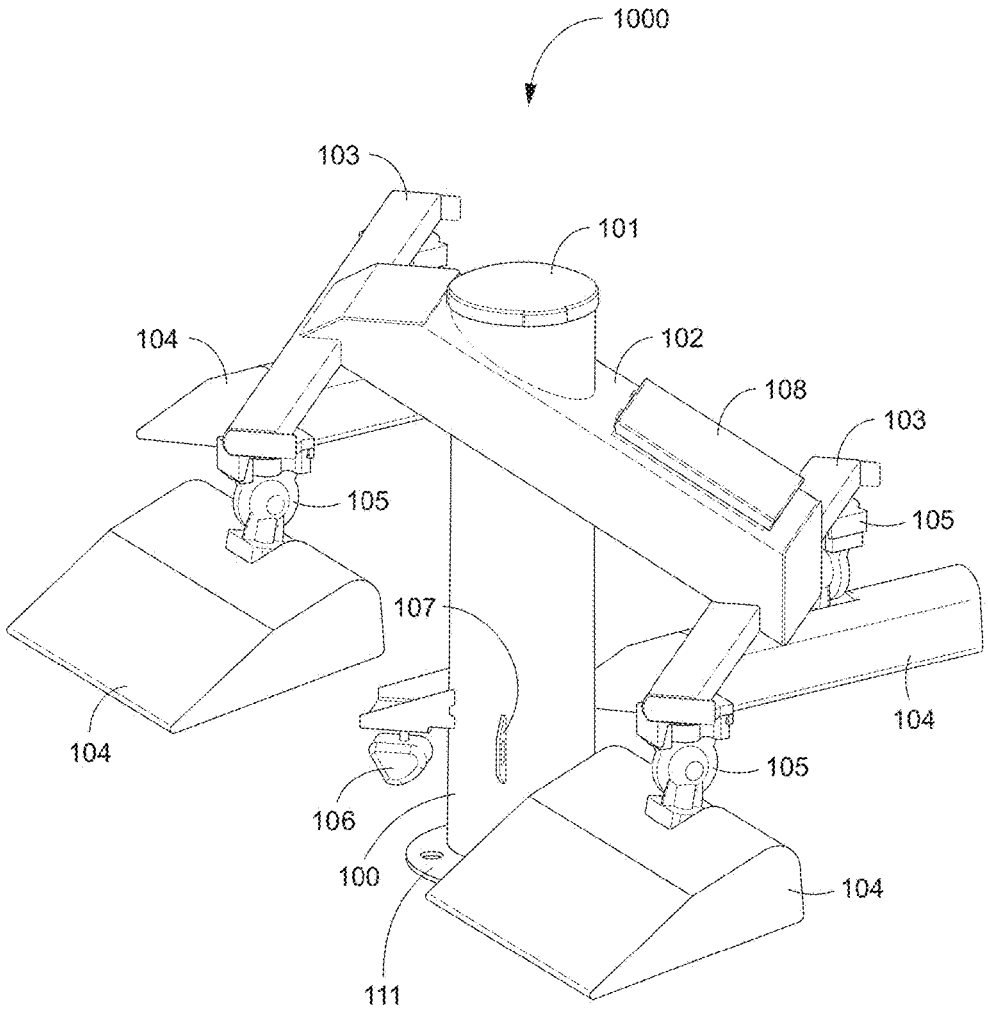
FIG. 12 illustrates the pole top fitter assembly of FIG. 3 as modified to include a mounting plate 111 at the end of fitter shaft 100 according to one possible alternative.

As has been stated, pole top fitters are not restricted to uses including an array of lighting fixtures elevated on slip-fit poles. Speakers, cameras, displays, or the like could be affixed to a tilted pole top fitter as is described herein and not depart from at least some aspects according to the present invention. A combination of devices (e.g., an array of luminaires, speakers, and displays) could be affixed to a single pole top fitter. A pole top fitter assembly according to aspects of the present invention may not be hollow, or have a circular cross-section, or be designed for a slip fit. For example, FIG. 12 illustrates pole top fitter assembly 1000 as modified with a mounting plate 111 at the end of fitter shaft 100. In this example, mounting plate 111 is more like an annular ring plate (rather than a solid piece) so to preserve an internal hollow for a wire run, though this is not by way of limitation. The modified fitter assembly 1000 of FIG. 12 could be bolted to a pole section, a concrete foundation, or some other elevating structure (e.g., side of a building) via fastening devices through the apertures in mounting plate 111. Of course, fastening devices through apertures may not be a suitable means of connection in some instances (e.g., in highly corrosive environments if the fastening devices and mounting plate are of different alloys). In such an instance other joining methods are possible (e.g., clamping, bolting, forming as a single part, welding, gluing). It is to be understood that aspects according to the present invention are not limited to any particular material or means of joining, manufacturing, or processing material(s).

Figure 13:
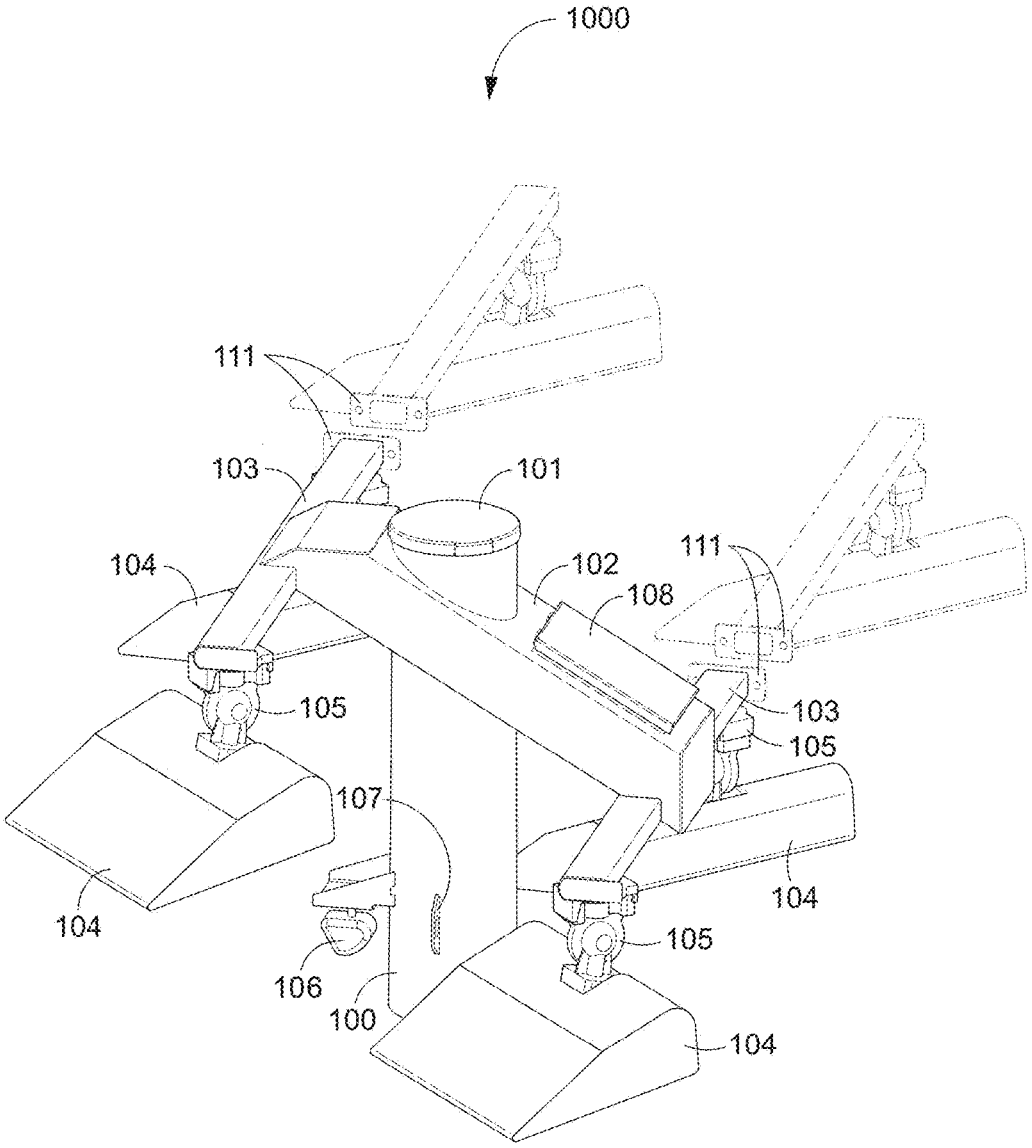
FIG. 13 illustrates the pole top fitter assembly of FIG. 3 as modified to include a mounting plate 111 at an end of cross-arms 103 according to another possible alternative.
Figure 14B:
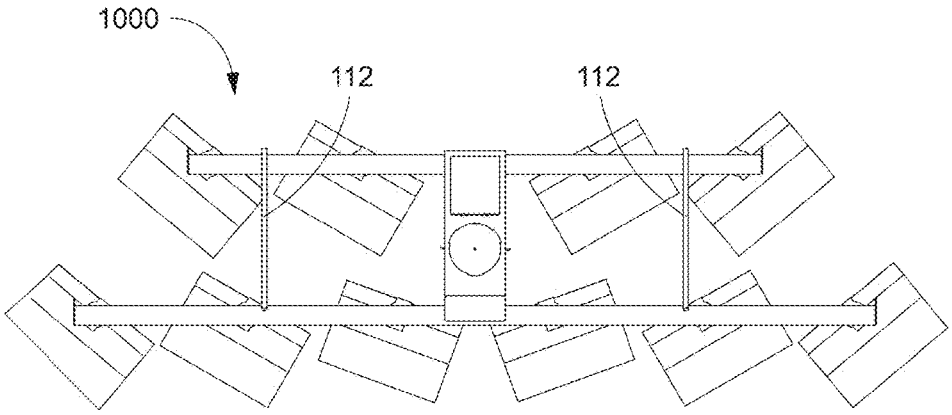

As previously stated, an entire pre-aimed pole top fitter assembly 1000 could be shipped to a site, elevated (e.g., via crane) and installed on a pole, and then rotated until the entire assembly is in a correct operational orientation. That being said, pre-aiming a pole top fitter assembly in a factory setting could be problematic as fixture count increases from six to seventeen, for example. The span of cross-arms 103 could become too large to house or move along an assembly line. As such, a pole top fitter assembly according to aspects of the present invention could be made modular such that it could contain one or more modular components, each component having a desired number of cross-arms 103, lighting fixtures 104, and/or other object. Each of these modular components could be pre-aimed at the factory in accordance with the methods described in aforementioned U.S. Pat. No. 7,500,764 and then assembled on site. For example, FIG. 13 illustrates pole top fitter assembly 1000 as modified with a mounting plate 111 at the end of cross-arms 103. If lighting needs change or it is discovered a pole can sustain more loading (as a non-limiting example), additional fixtures 104 could be affixed to an existing fitter assembly 1000 by bolting cross-arm sections together (see additional optional cross-arm sections and fixtures in ghost lines); these additional fixtures could be pre-aimed at the factory or on site. Of course, adding cross-arms 103 effectively lengthens the overall cross-arm—which could necessitate the use of spreader bars 112 (see FIGS. 14A and B). As envisioned, bars 112 are formed from the same material, affixed in the same manner, and at the same angle relative the fitter shaft as center cross-arm support 102, but spaced away from and not directly connected to the pole. The spreader bars help to stabilize the array of luminaires and prevent a "bouncing" effect (e.g., in high winds) which could impact the quality of lighting. Alternatively (or concurrently), similar mounting plates 111 could be installed at the end of center cross-arm support 102 to permit the addition of fixtures; this is illustrated in FIG. 15. As can be appreciated by reference to the figures, the length of cross-arms 103 can be by single-piece cross-arms 103 or bolted-together sections (compare the longer and different length cross-arms of FIGS. 14A and 14B with the bolted-together shorter sections of FIG. 13). Similarly, the length of center cross-arm support 102 could be in a single piece or multiple connectable sections (see FIG. 15).

Lastly, it is to be understood that aspects of the present invention could be included in part, or in whole, in a lighting system (or other system employing elevated and aimed objects)—not every feature described herein need be included to reap benefits according to the present invention. For example, a center cross-arm support 102 could still be employed, but instead of balancing lighting fixtures on the front and back side of the pole so to maintain a relatively stabilized load (see FIGS. 1A and B), all fixtures could be forward of the pole (see FIGS. 16A and B). While such a design may present eccentric loading on the pole, and may necessitate elongating part 102, it may be beneficial in extreme glare control situations (e.g., when the second row of fixtures is aimed at the base of the pole instead of across the playing field) where the risk of lighting the pole—and thereby creating localized glare—is high.

What is claimed is:

1. An apparatus for preventing uncontrolled uplight or localized glare in an array of elevated lighting fixtures designed to light a target area comprising:

a. a pole having a length, a top, a front side generally proximate the target area, a back side generally opposite the front side and distal the target area, and generally opposing sides;

b. a fitter having a first and second end and affixed to the pole at or near the top of the pole at a pre-determined angle relative the length of the pole such that the ends are at two different elevations from one another, wherein the first end is proximate the front side of the pole and the second end is proximate the back side of the pole;

c. a first cross-arm affixed to the first end of the fitter and a second cross-arm affixed to the second end of the titter such that the first and second cross-arms are at different elevations from one another and on opposite sides of the pole;

d. one or more lighting fixtures producing a light output and affixed to the first and second cross-arms such that the light output from one lighting fixture does not (i) interact with any other lighting fixture and produce uncontrolled uptight or (ii) strike the pole and produce localized glare.

2. The apparatus of claim 1 further comprising one or more adjustable armatures adapted to pan and tilt the one or more lighting fixtures relative the length of the pole.

3. The apparatus of claim 2 wherein the pole, fitter, first and second cross-arms, and adjustable armatures are substantially hollow and adapted to house power wiring for the one or more lighting fixtures.

4. The apparatus of claim 1 further comprising a third cross-arm adapted to removably bolt to the first or second cross-arm and to which one or more additional lighting fixtures are affixed.

5. The apparatus of claim 4 further comprising one or more additional cross-arms adapted to removably bolt to first, second, or third cross-arms and to which one or more additional lighting fixtures are affixed.

6. The apparatus of claim 1 further comprising a second fitter adapted to removably bolt to the fitter and to which one or more additional cross-arms or lighting fixtures are affixed.

7. The apparatus of claim 1 further comprising a pair of spreader bars adapted to connect the first and second cross-arms wherein each of the pair of spreader bars is on opposing sides of the pole and at the same pre-determined angle relative the length of the pole as the fitter.

8. An apparatus for preventing uncontrolled uplight or localized glare in an array of elevated lighting fixtures designed to light a target area comprising:

a. a pole having a length, a top, a front side generally proximate the target area, a back side generally opposite the front side and distal the target area, and generally opposing sides;

b. a fitter having a first and second end and affixed to the pole at or near the top of the pole at a pre-determined angle relative the length of the pole such that the ends are at two different elevations from one another, wherein the first end is proximate the front side of the pole and the second end is proximate the back side of the pole;

c. a first cross-arm affixed to the fitter at or near the first end and a second cross-arm affixed to the fitter closer to the second end such that the first and second cross-arms are at different elevations from one another but both on the front side of the pole;

d. one or more lighting fixtures producing a light output and affixed to the first and second cross-arms such that the light output from one lighting fixture does not (i) interact with any other lighting fixture and produce uncontrolled uplight or (ii) strike the pole and produce localized glare.

9. A method of lighting a target area with an array of elevated lighting fixtures while preventing uncontrolled uplight or localized glare comprising:

a. identifying one or more requirements of the target area;

b. identifying one or more pole locations relative the target area;

c. identifying one or more characteristics of one or more lighting fixtures elevated at the one or more pole locations;

d. designing a pole top fitter to affix the one or more lighting fixtures to one or more poles at an elevated position at the one or more pole locations comprising:

i. positioning the one or more lighting fixtures on the pole top fitter such that the one or more characteristics of the lighting fixtures does not result in uncontrolled uplight or localized glare at the pole; and ii. positioning the one or more lighting fixtures on the pole top fitter such that the requirements of the target area are met by the lighting fixtures.

10. The method of claim 9 wherein the step of designing a pole top fitter to affix the one or more lighting fixtures to one or more poles at the one or more pole locations further comprises:

a. positioning the one or more lighting fixtures on the pole top fitter such that all the lighting fixtures project light forward of the pole; and b. positioning the one or more lighting fixtures on the pole op fitter such that no light strikes the pole.

11. The method of claim 9 wherein the step of positioning the one or more lighting fixtures on the pole top fitter such that the requirements of the target area are met by the lighting fixtures comprises:

a. panning and tilting each lighting fixture via an adjustable armature so to achieve a specific aiming angle;

b. ensuring no specific aiming angle of a lighting fixture causes physical or photometric interference with another lighting fixture; and c. inserting a light-blocking device proximate any lighting fixture which produces undesired uplight after panning and tilting.

12. An apparatus to mount an array of lighting fixtures at an elevated position to a pole comprising:

a. a center cross-arm support having:

i. first and second opposite ends; and ii. an opening through an intermediate portion to receive a portion of a pole;

iii. the portion of the pole having a longitudinal axis and the opening through the intermediate portion of the center cross-arm support configured to mount the center cross-arm support at an angle to the longitudinal axis of the portion of the pole;

b. a cross-arm mounted to each of the first and second opposite ends of the center cross-arm support; and c. at least one mounting location for a lighting fixture and adjustable armature on each cross-arm.

13. The apparatus of claim 12 wherein the center cross-arm support comprises a substantially hollow and elongated housing.

14. The apparatus of claim 12 wherein the pole portion comprises a pole top fitter section that can be placed on top a pole.

15. The apparatus of claim 14 in combination with a pole and a plurality of lighting fixtures on the cross-arms.

16. The apparatus of claim 15 wherein the angle is selected to avoid physical and photometric interference between the plurality of lighting fixtures.

17. The apparatus of claim 16 wherein the angle is 30 degrees.

18. The apparatus of claim 12 further comprising a mounting interface at one of first and second opposite ends of the center cross-arm support to receive a center cross-arm support extension having a cross-arm.

19. The apparatus of claim 12 further comprising a mounting interface on at least one cross-arm to receive a cross-arm extension.

20. The apparatus of claim 12 in combination with a plurality of lighting fixtures mounted at adjustable armatures at the mounting locations on the cross-arms wherein:

a. each cross-arm extends symmetrically outwardly from the center cross-arm support; and b. the lighting fixtures of each cross-arm positioned symmetrically relative to the center cross-arm support;

c. such that the center cross-arm support, cross-arms, and lighting fixtures are configured for an at least substantially balanced or stabilized load on the pole.

* * * * *